US009591388B2

(12) United States Patent
Tanabe

(10) Patent No.: US 9,591,388 B2
(45) Date of Patent: Mar. 7, 2017

(54) IN-CAR AUDIO SYSTEM

(71) Applicant: Alpine Electronics, Inc., Tokyo (JP)

(72) Inventor: Kei Tanabe, Fukushima (JP)

(73) Assignee: Alpine Electronics, Inc., Tokyo (JP)

( * ) Notice: Subject to any disclaimer, the term of this patent is extended or adjusted under 35 U.S.C. 154(b) by 207 days.

(21) Appl. No.: 14/485,187

(22) Filed: Sep. 12, 2014

(65) Prior Publication Data

US 2015/0098586 A1 Apr. 9, 2015

(30) Foreign Application Priority Data

Oct. 3, 2013 (JP) ..... 2013-208423

(51) Int. Cl.

| | |
|---|---|
| ***H04R 1/02*** | (2006.01) |
| ***H04R 1/00*** | (2006.01) |
| ***H04R 1/28*** | (2006.01) |
| ***H04R 7/00*** | (2006.01) |

(52) U.S. Cl.

CPC ..... *H04R 1/00* (2013.01); *H04R 1/2849* (2013.01); *H04R 7/00* (2013.01); *H04R 1/2896* (2013.01); *H04R 2499/13* (2013.01)

(58) Field of Classification Search

CPC ..... H04R 2499/13
USPC ..... 381/86, 389
See application file for complete search history.

(56) References Cited

U.S. PATENT DOCUMENTS

2006/0291687 A1* 12/2006 Maekawa ..... H04R 1/2842 381/389
2013/0188806 A1* 7/2013 Tada ..... H04R 1/2803 381/86

FOREIGN PATENT DOCUMENTS

| | | |
|---|---|---|
| JP | 62-137247 | 6/1987 |
| JP | 63-287296 | 11/1988 |
| JP | 2012-015703 | 1/2012 |

OTHER PUBLICATIONS

Machine Translation of Japanese Publication No. 2012-015703, Tada, Jan. 19, 2012.*
Search Report from EPO for Application No. 14187048.5 dated Feb. 20, 2015.

* cited by examiner

*Primary Examiner* — Paul S Kim
*Assistant Examiner* — Katherine Faley
(74) *Attorney, Agent, or Firm* — Brinks Gilson & Lione

(57) ABSTRACT

An in-car audio system includes a speaker unit. A frame of the speaker unit is fixed to a support plate serving as part of the structural member of a vehicle via a partition wall member. The support plate has an opening formed therein. A duct is connected to the opening, and the opening communicates with the outside of the vehicle. A space surrounded by the speaker unit, the support plate, and a partition wall member serves as a first acoustic resonance space, and a communication channel located inside the duct serves as a second acoustic resonance space.

12 Claims, 8 Drawing Sheets

IN-CAR AUDIO SYSTEM

RELATED APPLICATION

The present application claims priority to Japanese Application Number 2013-208423, filed Oct. 3, 2013, the entirety of which is hereby incorporated by reference.

BACKGROUND

Field

The present disclosure relates to an in-car audio system that has a speaker unit mounted therein using a structural member of a vehicle and that is capable of preventing interference between the sound pressures radiating from the sound radiating side and the opposite side of a diaphragm of the speaker unit.

Description of the Related Art

In-car audio systems need to have a speaker unit disposed in a limited space of a motor vehicle and form a baffle structure in order to prevent the interference between sound waves radiating from the sound radiating side of a diaphragm to a vehicle interior and opposite-phase sound waves radiating from the opposite side of the diaphragm.

Japanese Unexamined Patent Application Publication No. 62-137247 describes an in-car audio system including a speaker bracket fixed to a vehicle body and a frame of a speaker unit fixed to the speaker bracket. A luggage side rim is disposed on the sound radiating side of the speaker unit, and a speaker grill that covers the sound radiating side of the speaker unit is fixed to the luggage side trim.

In addition, to prevent the interference between sound pressures having opposite phases, a sound leakage prevention spacer is sandwiched by the speaker unit and the luggage side trim. In this manner, the interference between the sound pressures in a gap between the speaker unit and the speaker grill can be prevented.

SUMMARY

As described in Japanese Unexamined Patent Application Publication No. 62-137247, existing in-car audio systems are required to fix a large speaker bracket that supports a speaker unit to the interior of a vehicle body. In addition, existing in-car audio systems are required to have a member, such as a spacer, attached thereto in order to form a baffle structure for preventing the interference between sound pressures. Accordingly, the number of parts that constitute the in-car audio system increases. Furthermore, the space for accommodating the in-car audio system is required within limited interior space of a vehicle.

Accordingly, it is an object of the present disclosure to provide an in-car audio system that allows a speaker unit to be mounted using the structural member of a vehicle and that is capable of preventing interference between the sound pressures on the sound radiating side and the opposite side of a diaphragm of the speaker unit.

According to an embodiment of the present disclosure, an in-car audio system includes a speaker unit having a diaphragm and a magnetic circuit supported by a frame, where the magnetic circuit drives the diaphragm. An outer circumferential portion of the frame is fixed to a surface of a support plate that serves as part of a vehicle structure and that is disposed inward of an exterior panel of the vehicle via a partition wall member having an internal space. One side of the diaphragm faces the internal space, and sound wave vibration is provided toward the vehicle interior from the other side of the diaphragm. The vehicle has a communication channel formed therein, and the communication channel allows the internal space to communicate with the outside of the vehicle.

In the in-car audio system, the diaphragm having a cone shape may be supported by the outer circumferential portion of the frame. The concave side of the diaphragm may face the internal space, and sound wave vibration may be provided toward the vehicle interior from the convex side of the diaphragm. In addition, each of the internal space and the communication channel may be used as an acoustic resonance space.

In the in-car audio system according to the present disclosure, since the speaker unit is supported by the support plate, which is part of the vehicle structure, the need for a speaker bracket serving as a member for fixing the speaker unit can be eliminated. In addition, a partition wall member is disposed between a surface of the support plate and the speaker unit, and the internal space of the partition wall member and a communication channel that communicates with the outside of the vehicle body are used as an acoustic resonance space. Accordingly, interference between sound waves radiating from both sides of the diaphragm and having opposite phases can be prevented. In addition, a sufficient sound pressure can be provided in the vehicle interior.

The support plate may have an opening formed therein, and the opening may communicate with the internal space. The communication channel may be formed between the exterior panel and the support plate, and the communication channel may allow the internal space to communicate with the outside of the vehicle via the opening.

In such a case, it is desirable that a duct connected to the opening be provided between the exterior panel and the support plate, and the communication channel be formed inside the duct.

In the above-described in-car audio system, the communication channel is formed between the exterior panel, which is part of the vehicle structure, and the support plate. Accordingly, a member that forms a baffle structure need not be disposed in the vehicle interior and, thus, the space of the vehicle interior can be effectively used.

A spare tire may be disposed inward of the support plate, and the speaker unit may be covered by a wheel that supports the spare tire.

In such a configuration, the in-car audio system can be disposed in a space for a spare tire. Accordingly, the space of the vehicle interior can be more effectively used.

A wall opening may be formed in part of the partition wall member, and the wall opening may communicate with the communication channel.

In such a case, the in-car audio system may further include a duct connected to the wall opening, and the communication channel may be formed inside the duct.

The diaphragm of the speaker unit may vibrate at a frequency in a sub-woofer frequency range.

According to the in-car audio system of the present disclosure, the speaker unit is supported using part of the structure of a vehicle. Thus, the need for a bracket for mounting the speaker unit can be eliminated. Thus, the number of structural members can be reduced. In addition, since a space formed between the support plate and the speaker unit and the communication channel extending to the outside of the vehicle are used as an acoustic resonance space, interference between sound waves radiating from both sides of the diaphragm can be prevented. Furthermore, a sufficient sound pressure can be delivered to the vehicle interior.

DESCRIPTION OF THE PREFERRED EMBODIMENTS

Figure 1:
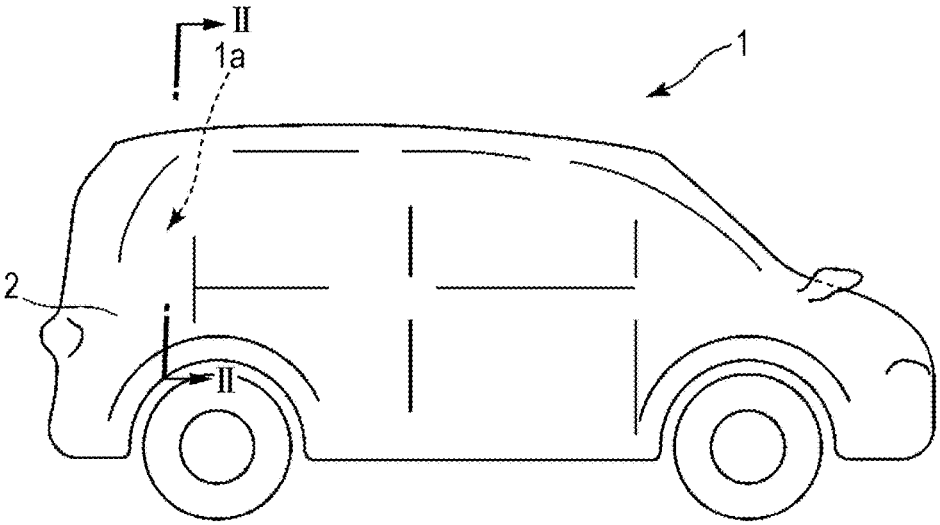
FIG. 1 is a side view illustrating an example of a vehicle having an in-car audio system mounted therein according to an embodiment of the present disclosure.
Figure 2:
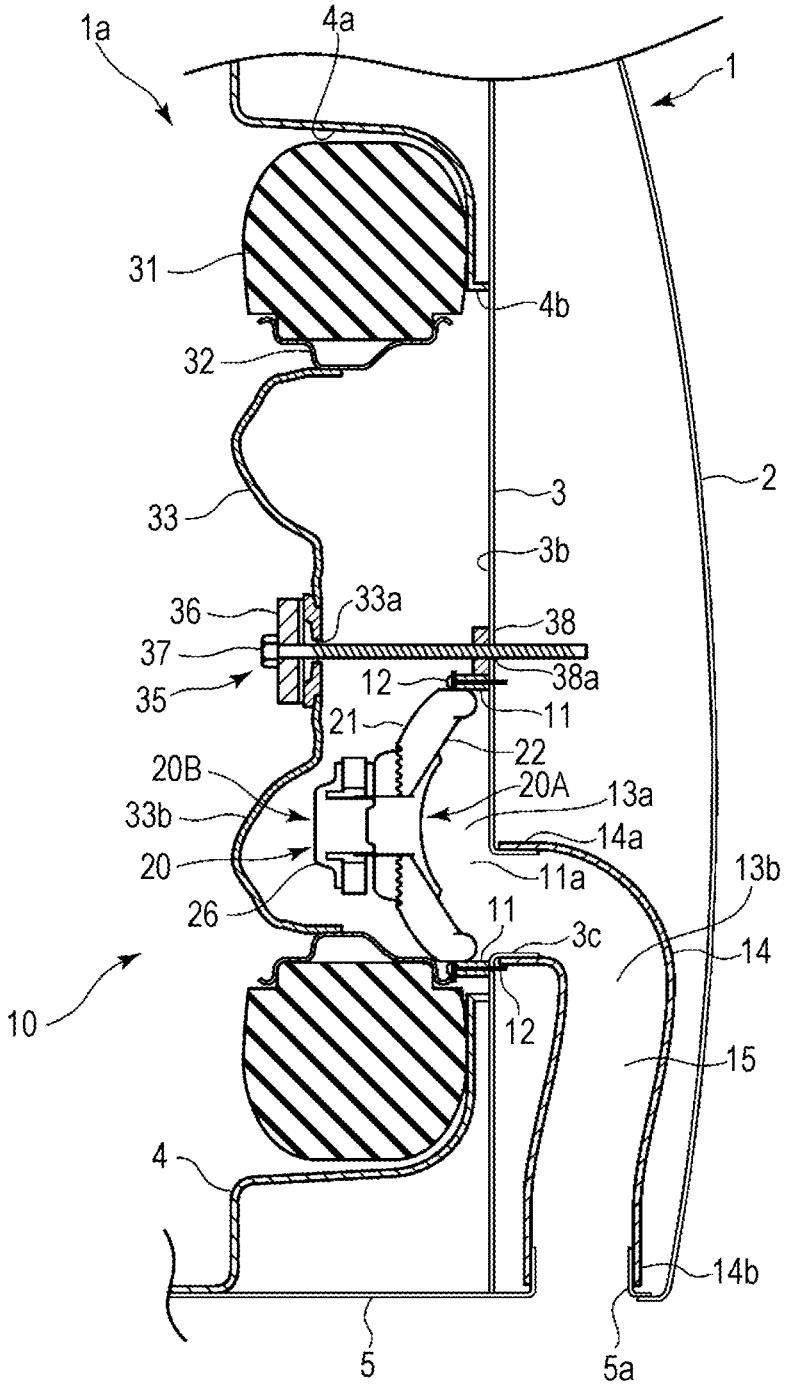
FIG. 2 is a cross-sectional view taken along a line II-II of FIG. 1 and illustrating part of the structure of a vehicle and the in-car audio system according to a first exemplary embodiment.
Figure 3:
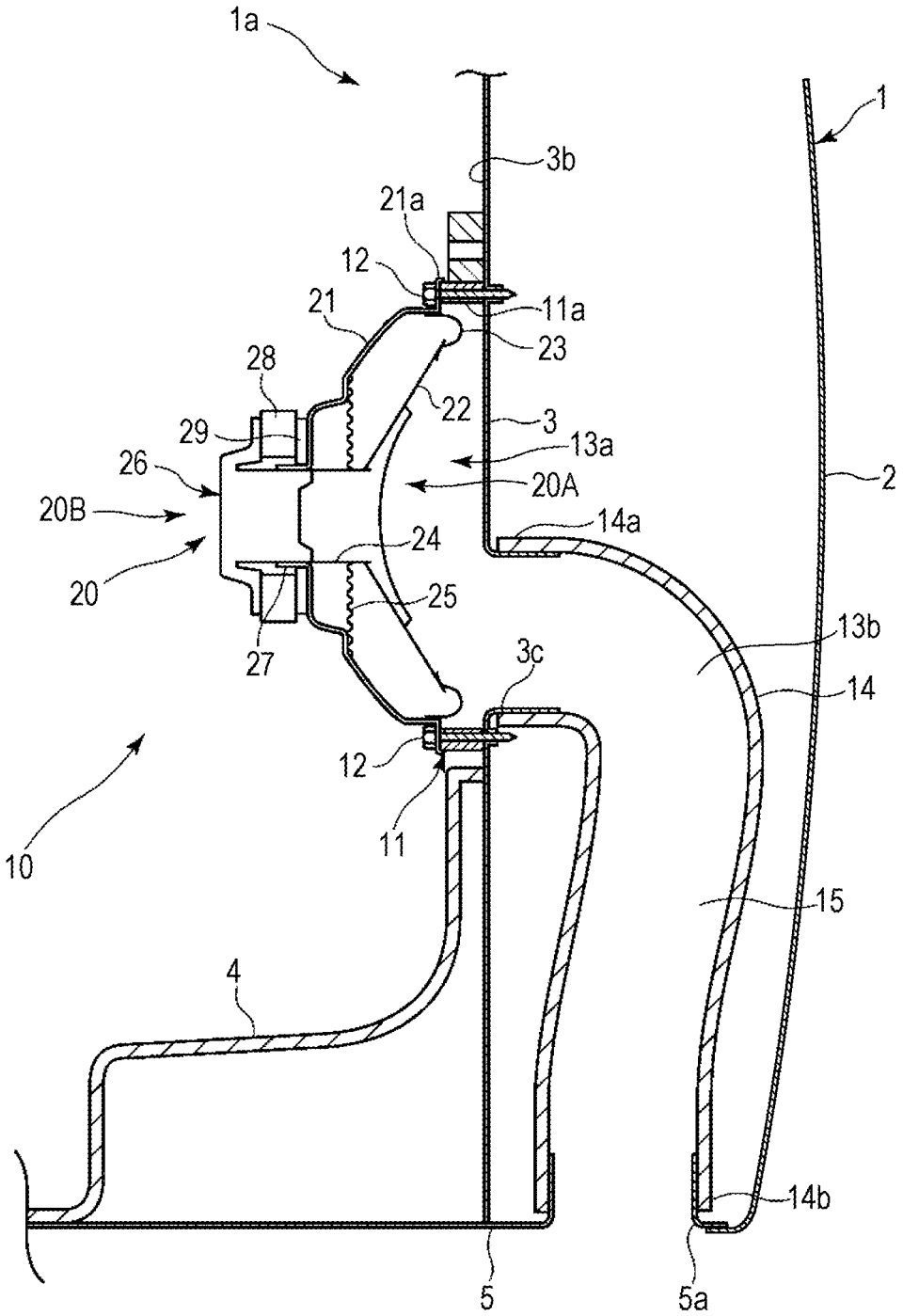
FIG. 3 is a partial enlarged view of FIG. 2.

As illustrated in FIG. 1, a vehicle 1 may be a sport utility vehicle (SUV). FIGS. 2 and 3 are cross-sectional views of the structure of the right side portion of a rear trunk region 18 of the vehicle 1 taken along a line II-II of FIG. 1.

As illustrated in FIGS. 2 and 3, in the rear trunk region 1*a*, a metal support plate 3 is disposed inward of a metal exterior panel 2 of the vehicle 1. In addition, a metal interior plate 4 is disposed inward of the support plate 3. Furthermore, an in-car audio system 10 according to a first exemplary embodiment of the present disclosure is mounted on the right of the rear trunk region 1*a*.

The in-car audio system 10 includes a speaker unit 20. As can be seen from the enlarged view of FIG. 3, the speaker unit 20 includes a frame 21. The outer circumferential edge of a diaphragm 22 is supported by an outer circumferential portion 21*a* of the frame 21 via an edge member 23. A coil bobbin 24 having a cylindrical shape is joined to a convex side of the diaphragm 22 at the center of the convex portion. The coil bobbin 24 is supported by the frame 21 via a damper member 25.

The frame 21 has a magnetic circuit 26 fixed thereto. The magnetic circuit 26 faces the convex side of the diaphragm 22. The magnetic circuit 26 includes a voice coil 27 fixed to the coil bobbin 24, a magnet 28, and a magnetic yoke 29 that applies the magnetic field of the magnet 28 to the voice coil 27.

As illustrated in FIGS. 2 and 3, the speaker unit 20 has a first side 20A to which the outer circumferential portion 21*a* of the frame 21 and a concave side of the cone-shaped diaphragm 22 are directed and a second side 20B to which the convex side of the diaphragm 22 and the magnetic circuit 26 are directed. The speaker unit 20 is disposed so that the first side 20A is directed to the support plate 3 and the second side 20B is directed to the vehicle interior.

Figure 4:
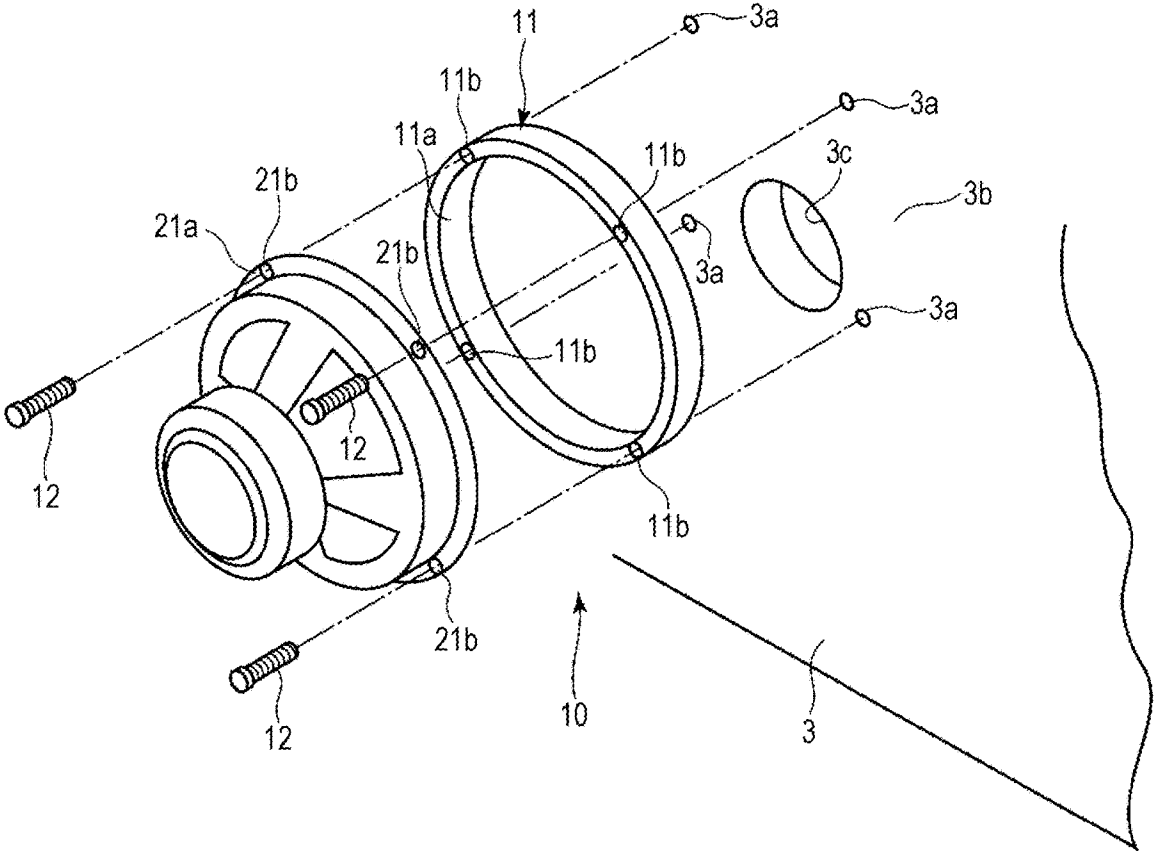
FIG. 4 is an exploded perspective view of the in-car audio system according to the first exemplary embodiment.

A partition wall member 11 is disposed between the speaker unit 20 and the support plate 3. The partition wall member 11 serves as a sound insulation spacer. As illustrated in FIG. 4, the partition wall member 11 has a ring shape, and the partition wall member 11 has a circular internal space 11*a*.

As illustrated in FIG. 4, a plurality of mounting holes 11*b* are formed in the partition wall member 11 so as to pass through the partition wall member 11. A plurality of mounting holes 21*b* are formed in the outer circumferential portion 21*a* of the frame 21 of the speaker unit 20. A plurality of female threaded screw holes 3*a* are formed in the support plate 3, which is part of the structure of the vehicle 1. The partition wall member 11 is sandwiched by the support plate 3 and the outer circumferential portion 21*a* of the frame 21. Thereafter, fixing screws 12 are inserted into the mounting holes 21*b* of the outer circumferential portion 21*a* and the mounting holes 11*b* of the partition wall member 11. The top end portions of the fixing screws 12 are screwed to the female threaded screw holes 3*a* of the support plate 3.

As illustrated in FIGS. 2 and 3, the first side 20A of the speaker unit 20 is directed to an inner surface 3*b* of the support plate 3, and the outer circumferential portion 21*a* of the frame 21 is fixed to the inner surface 3*b* with a spacing therebetween. Since the partition wall member 11 is disposed between the outer circumferential portion 21*a* of the frame 21 and the inner surface 3*b* of the support plate 3, the space between the concave side of the diaphragm 22 and the inner surface 3*b* is enclosed by the partition wall member 11 and, thus, is sealed from external air.

As illustrated in FIGS. 2 and 3, an opening 3*c* is formed in the support plate 3. The diameter or the opening area of the opening 3*c* may be any value less than or equal to the diameter or the opening area of the partition wall member 11. In addition, a duct 14 is disposed in a space between the exterior panel 2 of the vehicle 1 and the support plate 3. An upper end portion 14*a* of the duct 14 is connected to the opening 3*c* of the support plate 3. A bottom plate 5 of the vehicle body of the vehicle 1 has an external opening 5*a* formed therein. The external opening 5*a* faces downward. A lower end portion 14*b* of the duct 14 is connected to the external opening 5*a*.

A communication channel 15 is formed in the duct 14. The communication channel 15 communicates with the internal space 11*a* of the partition wall member 11 via the opening 3*c* of the support plate 3. In addition, the communication channel 15 communicates with the external air outside the vehicle 1 through the external opening 5*a*.

A first acoustic resonance space 13*a* is formed by the internal space 11*a* of the partition wall member 11 on the first side 20A of the speaker unit 20. More specifically, the first acoustic resonance space 13*a* is formed as a space surrounded by the concave side surface of the diaphragm 22, the inner surface 3*b* of the support plate 3, and the partition wall member 11. In addition, a second acoustic resonance space 13*b* is formed by the communication channel 15 in the duct 14.

The speaker unit 20 serves as a sub-woofer, which mainly provides the bass with a frequency of 50 Hz to 150 Hz. The volume of the second acoustic resonance space 13*b* is larger than the volume of the first acoustic resonance space 13*a*. Thus, the first acoustic resonance space 13*a* and the second acoustic resonance space 13*b* can create Helmholtz resonance or resonance similar to Helmholtz resonance.

As illustrated in FIG. 2, the interior plate 4 has a circular holding concave portion 4*a* formed therein in an integrated manner. The holding concave portion 4*a* holds a spare tire 31. A bottom portion of the holding concave portion 4*a* has a circular hole 4*b* formed therein. The speaker unit 20 and the partition wall member 11 are attached to the inside of the hole 4*b*.

An inner diameter portion of the spare tire 31 is held by a flange 32. The flange 32 is fixed to the outer periphery of a wheel (a center disk) 33. A holding fixture 35 that fixes the spare tire 31 to the vehicle 1 includes a retainer plate 36 and a fixing screw shaft 37 inserted into the retainer plate 36. The support plate 3 has a fixing nut 38 fixed thereto by, for example, welding. The fixing nut 38 has a female threaded screw hole 38*a* formed therein.

To mount the spare tire 31 to the holding concave portion 4*a*, the fixing screw shaft 37 is inserted into a center hole 33*a* of the wheel 33. Thereafter, the top end of the fixing screw shaft 37 is screwed into the female threaded screw hole 38*a* of the fixing nut 38, and the fixing screw shaft 37 is tightened. If the fixing screw shaft 37 is tightened, the retainer plate 36 urges the center portion of the wheel 33 against the support plate 3. Thus, the spare tire 31 is held in the holding concave portion 4*a* of the interior plate 4.

The wheel (the center disk) 33 has a bulging portion 33*b* formed on an inner periphery side of the spare tire 31. When the spare tire 31 is held in the holding concave portion 4*a* of the interior plate 4, the speaker unit 20 is covered by the bulging portion 33*b*.

In the in-car audio system 10 illustrated in FIGS. 2 to 4, the second side 20B of the speaker unit 20 is directed to the vehicle interior. Thus, the sound waves radiating from the convex side of the diaphragm 22 are directed to the vehicle interior. In contrast, the first side 20A communicates with the outside of the vehicle 1 via the communication channel 15 formed using the internal space 11*a* of the partition wall member 11 and the duct 14.

By sealing the first side 20A of the speaker unit 20 using the partition wall member 11 and the duct 14 and allowing the first side 20A to communicate with the outside of the vehicle 1, a baffle structure is formed. In this manner, a phenomenon in which the sound waves generated by the vibration of the diaphragm 22 and radiating from the second side 20B to the vehicle interior and the sound waves emanating from the first side 20A and having an opposite phase cancel each other out by interference can be prevented.

On the first side 20A of the speaker unit 20, the partition wall member 11 is disposed between the frame 21 and the inner surface 3*b* of the support plate 3 to form the internal space 11*a*, which serves as the first acoustic resonance space 13*a*. The communication channel 15 in the duct 14 that communicates with the internal space 11*a* forms the second acoustic resonance space 13*b*.

By providing the partition wall member 11, the first acoustic resonance space 13*a* can be formed between the diaphragm 22 and the inner surface 3*b* of the support plate 3 even when the opening diameter (the opening area) of the opening 3*c* formed in the support plate 3 is sufficiently less than the diameter (the area) of the diaphragm 22. In addition, since the second acoustic resonance space 13*b* that communicates with the external air using the communication channel 15 in the duct 14 is formed. Helmholtz resonance or resonance similar to Helmholtz resonance can be created using the first acoustic resonance space 13*a* and the second acoustic resonance space 13*b*. Such resonance allows the diaphragm 22 to be driven with a large amplitude. Thus, excellent bass sounds can be sent to the vehicle interior at a large sound pressure level.

Since, in the in-car audio system 10, the speaker unit 20 is fixed to the support plate 3, which is a structural member of the vehicle 1, the need for a speaker bracket that is used in existing in-car audio systems can be eliminated. Since the speaker unit 20 can be mounted by using only the partition wall member 11 and the fixing screws 12, the number of parts for mounting the speaker unit 20 on the vehicle 1 can be reduced. In addition, since the speaker unit 20 is mounted so that the outer circumferential portion 21*a* of the frame 21 faces the inner surface 3*b* of the support plate 3 in parallel, the projection of the speaker unit 20 from the inner surface 3*b* can be reduced.

If, as illustrated in FIG. 2, the speaker unit 20 is disposed at a location at which the speaker unit 20 is covered by the wheel 33 that holds the spare tire 31, the speaker unit 20 does not appear in the vehicle interior. Accordingly, the space of the vehicle interior can be effectively used.

By providing the partition wall member 11 in the in-car audio system 10, the first acoustic resonance space 13*a* can be formed between the speaker unit 20 and the inner surface 3*b* of the support plate 3 and, thus, the Helmholtz resonance or resonance similar to the Helmholtz resonance can be created. Accordingly, the need for matching the opening area of the opening 3*c* of the support plate 3 to the diameter of the first side 20A of the speaker unit 20 can be eliminated. Accordingly, an existing hole formed in the vehicle 1 can be used as the opening 3*c*. Alternatively, even when an opening is formed in post-processing, the opening area can be reduced. Thus, in such a case, the duct 14 having a small diameter can be used.

Figure 5:
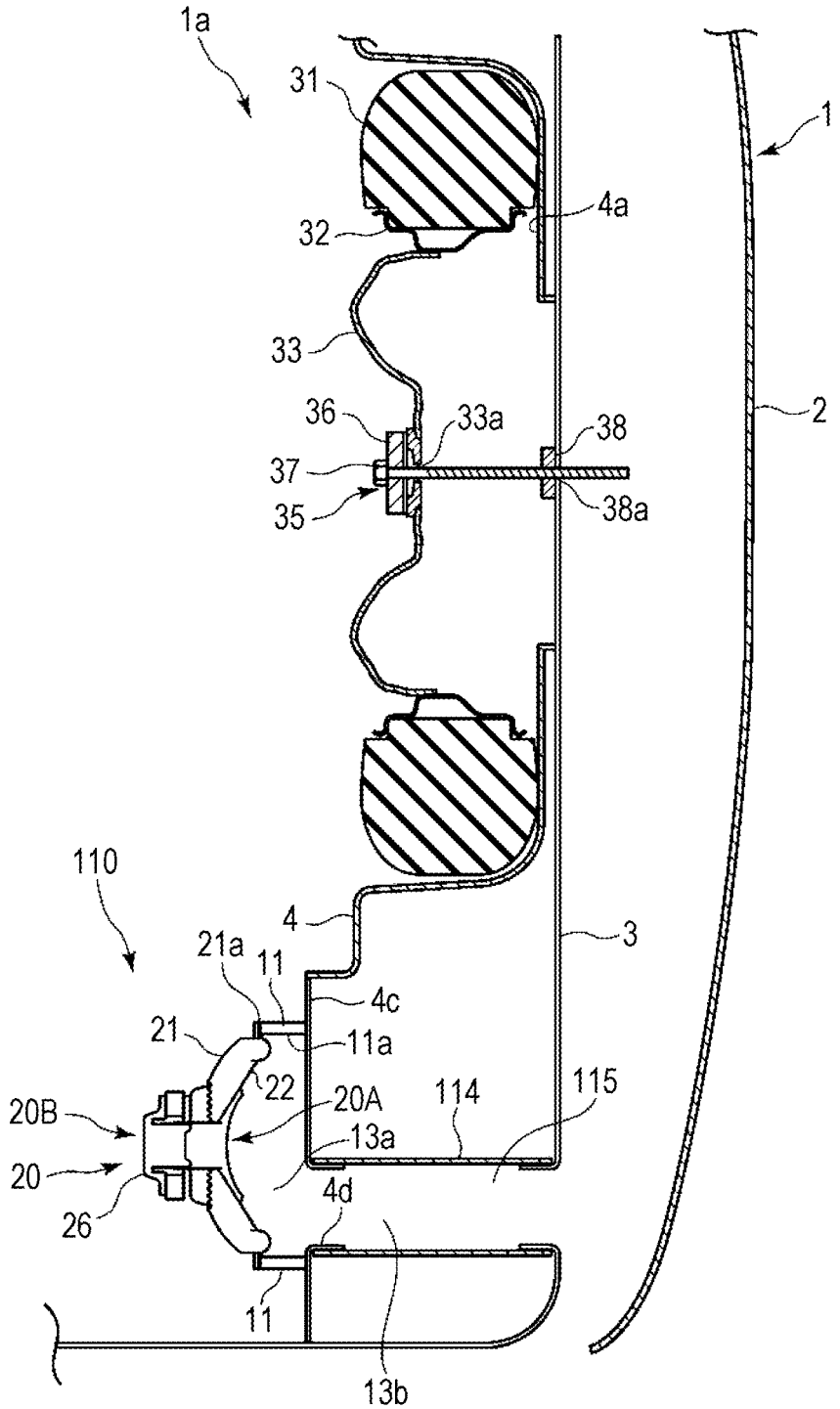
FIG. 5 is a cross-sectional view of an in-car audio system according to a second exemplary embodiment of the present disclosure.

FIG. 5 illustrates an in-car audio system 110 according to a second exemplary embodiment of the present disclosure. In the in-car audio system 110, part of the interior plate 4 located closest to the vehicle interior among members that constitute the vehicle 1 is used as a support plate 4*c*. The outer circumferential portion 21*a* of the frame 21 of the speaker unit 20 is fixed to the inner surface of the support plate 4*c* that faces the vehicle interior via the partition wall member 11.

An opening 4*d* is formed in the support plate 4*c* at a position at which the first side 20A of the speaker unit 20 faces the support plate 4*c*. A duct 114 is formed between the support plate 4*c*, which is part of the interior plate 4, and the support plate 3 located outward of the support plate 4*c*. A communication channel 115 in the duct 114 is connected to the opening 4*d*. In addition, the communication channel 115 opens to a space between the support plate 3 and the exterior panel 2. Furthermore, the communication channel 115 communicates with a space outside the vehicle through the space between the support plate 3 and the exterior panel 2.

In the in-car audio system 110 illustrated in FIG. 5, the first acoustic resonance space 13*a* is formed between the first side 20A of the speaker unit 20 and the support plate 4*c* and between the first side 20A and the partition wall member 11. The communication channel 115 in the duct 114 functions as the second acoustic resonance space 13*b*.

Figure 6:
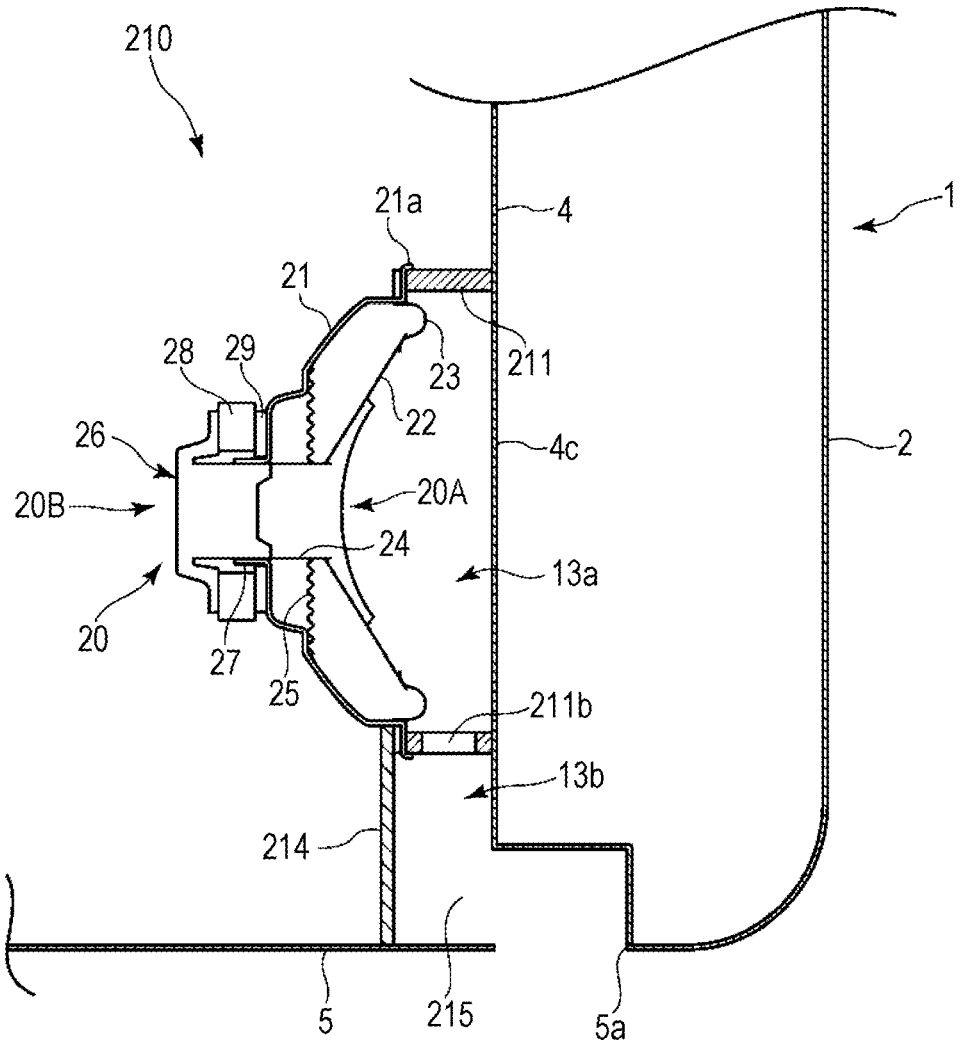
FIG. 6 is a cross-sectional view of an in-car audio system according to a third exemplary embodiment of the present disclosure.

FIG. 6 illustrates an in-car audio system 210 according to a third exemplary embodiment of the present disclosure. In the in-car audio system 210, part of the interior plate 4 of the vehicle 1 is used as the support plate 4*c*. A partition wall member 211 and the speaker unit 20 are fixed to the inner surface of the support plate 4*c* that faces the vehicle interior.

A wall opening 211*b* is formed in part of the partition wall member 211. The wall opening 211*b* communicates with a communication channel 215 partitioned by a partition wall 214. Alternatively, a duct may be connected to the wall opening 211*b* to form the communication channel 215. The communication channel 215 communicates with a space outside the vehicle through the external opening 5*a* formed in the bottom plate 5 of the vehicle 1.

Like the second exemplary embodiment, according to the present exemplary embodiment, the first acoustic resonance space 13*a* is formed between the first side 20A of the speaker unit 20 and the support plate 4*c* and between the first side 20A and the partition wall member 211. In addition, the communication channel 215 functions as the second acoustic resonance space 13*b*.

According to the exemplary embodiments illustrated in FIGS. 2 to 6, the first side 20A of the speaker unit 20 faces the surfaces of the support plate 3 or the support plate 4*c*. In such a configuration, the concave side of the cone-shaped diaphragm 22 faces the internal space 11*a* of the partition wall member 11 or internal space 211*a* of the partition wall member 211. Accordingly, the large first acoustic resonance space 13*a* can be formed between the diaphragm 22 and the support plate 3 or between the diaphragm 22 and the support plate 4*c*. In addition, projection of the speaker unit 20 into the vehicle interior can be reduced.

Figure 7:
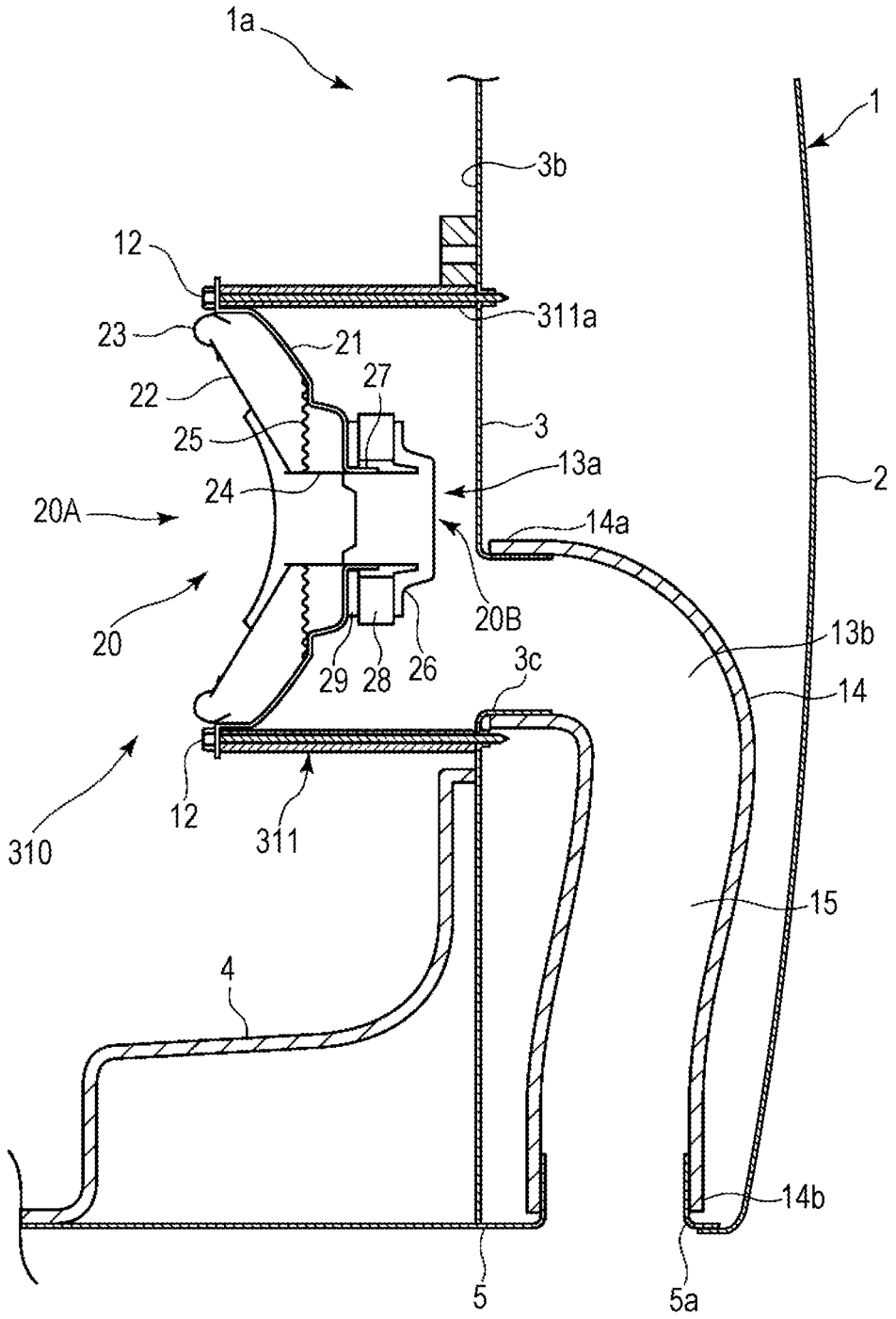
FIG. 7 is a cross-sectional view of an in-car audio system according to a fourth exemplary embodiment of the present disclosure.

FIG. 7 illustrates an in-car audio system 310 according to a fourth exemplary embodiment of the present disclosure. In the in-car audio system 310, a partition wall member 311 having a large size in the right-left direction of FIG. 7 is provided. The first side 20A of the speaker unit 20 supported by the partition wall member 311 faces the vehicle interior. The second side 20B of the speaker unit 20 faces the support plate 3. A plurality of holes are formed in the frame 21 of the speaker unit 20. In internal space 311*a* of the partition wall member 311, the first acoustic resonance space 13*a* is formed between the convex side of the diaphragm 22 and the support plate 3.

Figure 8:
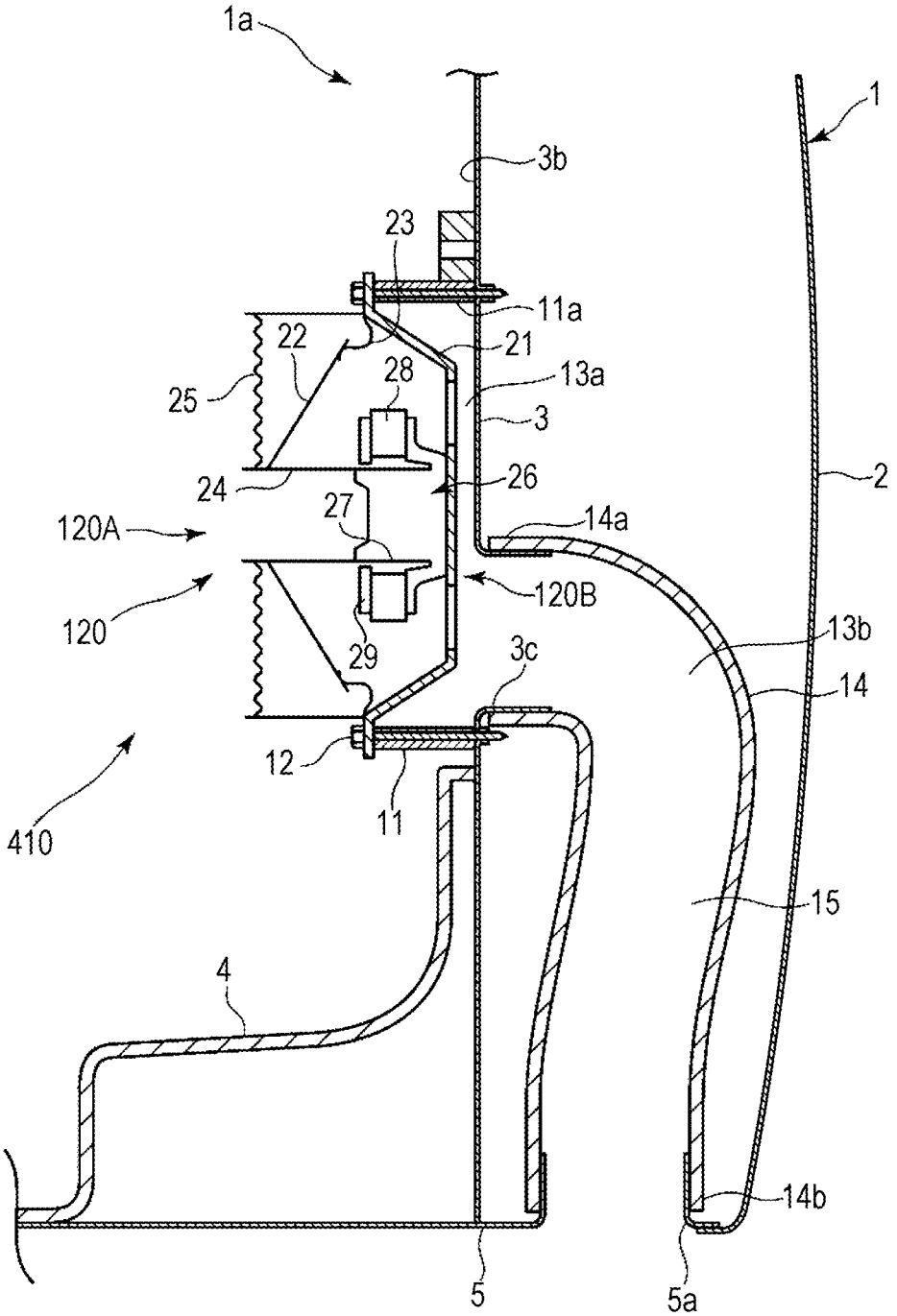
FIG. 8 is a cross-sectional view of an in-car audio system according to a fifth exemplary embodiment of the present disclosure.

FIG. 8 illustrates an in-car audio system 410 according to a fifth exemplary embodiment of the present disclosure. In the in-car audio system 410, the outer circumferential portion of the frame 21 of a speaker unit 120 is fixed to the partition wall member 11. A first side 120A of the speaker unit 120 faces the vehicle interior, and a second side 120B of the speaker unit 120 faces the support plate 3. The magnetic circuit 26 is disposed so as to be adjacent to the support plate 3. The diaphragm 22 is disposed so as to be adjacent to the vehicle interior. In addition, the concave side of the diaphragm 22 of the diaphragm 22 faces the support plate 3, and the first acoustic resonance space 13*a* is formed between the concave side of the diaphragm 22 and the support plate 3.

What is claimed is:

1. An in-car audio system comprising:

a speaker unit having a diaphragm and a magnetic circuit both supported by a frame, the diaphragm being driveable by the magnetic circuit, wherein an outer circumferential portion of the frame is fixed to a surface of a support plate that serves as part of a vehicle structure and that is disposed inward of an exterior panel of the vehicle via a partition wall member having an internal space, wherein the support plate has an opening formed therein, and the opening communicates with the internal space, wherein a front side of the diaphragm faces the internal space and the exterior panel, and sound wave vibration is provided toward the vehicle interior from a rear side of the diaphragm, wherein the vehicle has a communication channel formed therein between the exterior panel and the support plate, and where the communication channel is configured to allow the internal space to communicate with an outside of the vehicle via the opening, wherein a duct connected to the opening is provided between the exterior panel and the support plate, and the communication channel is formed inside the duct, and wherein a spare tire is disposed inward of the support plate, and the speaker unit is covered by a wheel that supports the spare tire.

2. The in-car audio system according to claim 1, wherein the diaphragm having a cone shape is supported by the outer circumferential portion of the frame, and wherein the front side of the diaphragm is concave in shape, and sound wave vibration is provided toward the vehicle interior from the rear side of the diaphragm that is convex in shape.

3. The in-car audio system according to claim 1, wherein each of the internal space and the communication channel is used as an acoustic resonance space.

4. The in-car audio system according to claim 1, wherein the diaphragm of the speaker unit vibrates at a frequency in a sub-woofer frequency range.

5. The in-car audio system according to claim 1, wherein a wall opening is formed in part of the partition wall member, and the wall opening communicates with the communication channel.

6. The in-car audio system according to claim 5, further comprising:

a duct connected to the wall opening, wherein the communication channel is formed inside the duct.

7. The in-car audio system according to claim 6, wherein the diaphragm of the speaker unit vibrates at a frequency in a sub-woofer frequency range.

8. A method of producing in-car audio using a speaker unit, the speaker unit having a diaphragm and a magnetic circuitry supported by a frame, the method comprising:

fixing an outer circumferential portion of the frame to a surface of a support plate that serves as part of a vehicle structure and that is disposed inward of an exterior panel of the vehicle via a partition wall member having an internal space; and, driving the diaphragm by a magnetic circuit;

wherein the support plate has an opening formed therein, and the opening communicates with the internal space, wherein a front side of the diaphragm faces the internal space and the exterior panel, and sound wave vibration is provided toward the vehicle interior from a rear side of the diaphragm, wherein the vehicle has a communication channel formed therein between the exterior panel and the support plate, and where the communication channel is configured to allow the internal space to communicate with an outside of the vehicle via the opening, wherein a duct connected to the opening is provided between the exterior panel and the support plate, and the communication channel is formed inside the duct, and wherein a spare tire is disposed inward of the support plate, and the speaker unit is covered by a wheel that supports the spare tire.

9. The method of claim 8, wherein the diaphragm having a cone shape is supported by the outer circumferential portion of the frame, and wherein the front side of the diaphragm is concave in shape, and sound wave vibration is provided toward the vehicle interior from the rear side of the diaphragm that is convex in shape.

10. The method of claim 8, wherein each of the internal space and the communication channel is used as an acoustic resonance space.

11. The method of claim 8, wherein the diaphragm of the speaker unit vibrates at a frequency in a sub-woofer frequency range.

12. The method of claim 11, wherein a duct is connected to a wall opening, and wherein the communication channel is formed inside the duct.

* * * * *